US008041044B2

(12) United States Patent
Klemenz et al.

(10) Patent No.: US 8,041,044 B2
(45) Date of Patent: Oct. 18, 2011

(54) METHOD AND APPARATUS FOR CHECKING A MEASURING SITUATION IN THE CASE OF A HEARING APPARATUS

(75) Inventors: Harald Klemenz, Fürth (DE); Hartmut Ritter, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1317 days.

(21) Appl. No.: 11/651,754

(22) Filed: Jan. 10, 2007

(65) Prior Publication Data

US 2007/0175281 A1 Aug. 2, 2007

(30) Foreign Application Priority Data

Jan. 13, 2006 (DE) ..... 10 2006 001 845

(51) Int. Cl.
*H04R 29/00* (2006.01)

(52) U.S. Cl. ..... 381/60; 381/58

(58) Field of Classification Search ..... 381/58, 381/60

See application file for complete search history.

(56) References Cited

U.S. PATENT DOCUMENTS

| | | | | |
|---|---|---|---|---|
| 4,095,057 | A | 6/1978 | Power et al. | |
| 5,812,674 | A | 9/1998 | Jot et al. | |
| 6,718,296 | B1 | 4/2004 | Reynolds et al. | |
| 7,003,128 | B2 * | 2/2006 | Boonen | 381/322 |
| 7,197,152 | B2 * | 3/2007 | Miller et al. | 381/326 |
| 7,548,625 | B2 * | 6/2009 | Dorfman et al. | 381/58 |
| 2005/0259829 | A1 * | 11/2005 | Van den Heuvel et al. | 381/60 |

FOREIGN PATENT DOCUMENTS

| | | | |
|---|---|---|---|
| AU | 2005202243 | A1 | 12/2005 |
| DE | 196 34 155 | A1 | 2/1997 |
| DE | 699 24 743 | T2 | 8/2001 |
| WO | 2005125276 | A1 | 12/2005 |

* cited by examiner

*Primary Examiner* — Curtis Kuntz
*Assistant Examiner* — Ryan Robinson

(57) ABSTRACT

It should be possible to balance microphones and hearing apparatus more reliably. To this end, provision is made for a method for checking a measuring situation, wherein at least two measurement points of a frequency response of the hearing apparatus are recorded. A check then establishes whether the at least two measurement points lie in a predetermined tolerance range above a threshold. If this is the case, an OK signal is output. Otherwise, if at least one of the measurement points lies outside the tolerance range, the position of the measurement point outside the tolerance range is ascertained and a fault signal is output depending on the ascertained position. It is therefore possible to establish, for example, whether a measuring chamber lacks proofness, a microphone is blocked or the microphone is completely malfunctioning.

13 Claims, 1 Drawing Sheet

METHOD AND APPARATUS FOR CHECKING A MEASURING SITUATION IN THE CASE OF A HEARING APPARATUS

CROSS REFERENCE TO RELATED APPLICATIONS

This application claims priority of German application No. 10 2006 001 845.1 filed Jan. 13, 2006, which is incorporated by reference herein in its entirety.

FIELD OF THE INVENTION

The present invention relates to a method for checking a measuring situation when testing or adjusting a hearing apparatus, in particular a hearing device, in a measuring chamber. The present invention also relates to a corresponding apparatus for checking the measuring situation.

BACKGROUND OF THE INVENTION

Hearing devices, headsets and other hearing apparatuses must be checked and adjusted before use and possibly also during use in respect of their functionality. To this end, use is generally made of a measuring chamber in which the hearing apparatus can be exposed to defined noises and corresponding measurements can be carried out. In the broadest sense, the term measuring chamber can also be understood to signify a measuring room.

The applicant has developed a previously unpublished test method (DE 10 2005 032 272) for balancing a multi-microphone system in a hearing device. In this case, instead of a special measuring device, use is made of a programming interface (in particular a HIPRO) in conjunction with a PC. This HIPRO uses one connection to control a signal processing circuit for controlling a measuring box, and another connection to control the hearing device which must be measured. In this context, the signal processing circuit and the microphone of the measuring box can be parts of a normal hearing device, and therefore standard high-quality components can be utilized for the measuring apparatus.

An important prerequisite for the balancing of the multi-microphone system and for the implementation of this method in relation to the self-checking unit is the checking of the acoustic proofness of the test box and the basic functional checking of the multi-microphone system. This checking was previously dependent on the experience of a person skilled in the art. The speed and reliability with which the functional inefficiency of the hearing device and/or the calibration unit can be detected and resolved are dependent on this experience. Accurate analysis and error resolution can only be carried out by an expert, if at all.

Measuring the quality of voice signals is disclosed in the publication DE 699 24 743 T2. For this, a distorted signal, which corresponds to a test signal when it is distorted by the tested entity, is received and compared with the test signal in order to produce a distortion perception measurement that indicates the level at which the distortion of the signal would be perceptible for a human listener. Corresponding individual sections in the test signal and the distorted signal are selected and synchronized in order that a comparison between corresponding sections can be carried out. The results of each such comparison are combined in order to produce an overall measurement of the level at which the distortion of the signal would be perceptible for a human listener.

Furthermore, the document DE 196 34 155 A1 describes a method for simulating the acoustic quality of a room. This allows modification of sound signals which originate from a real source or generation of corresponding sound effects for recording media.

SUMMARY OF THE INVENTION

The present invention addresses the problem of organizing more reliably the adjustment and checking of a hearing apparatus, in particular a hearing device.

According to the invention, therefore, provision is made for a method for checking a measuring situation when testing or adjusting a hearing apparatus, in particular a hearing device, in a measuring chamber by recording at least two measurement points of a frequency response of the hearing apparatus, checking whether the at least two measurement points lie in a predetermined tolerance range and outputting an OK signal if this is the case and otherwise, if at least one of the measurement points lies outside the tolerance range, ascertaining the position of the measurement point outside the tolerance range and outputting a fault signal depending on the ascertained position.

According to the invention, moreover, provision is made for an apparatus for checking a measuring situation when testing or adjusting a hearing apparatus, in particular a hearing device, in a measuring chamber including a measuring entity for recording at least two measurement points of a frequency response of the hearing apparatus and an analysis entity for checking whether the at least two measurement points lie in a predetermined tolerance range and for outputting an OK signal if they lie in the tolerance range and otherwise, if at least one of the measurement points lies outside the tolerance range, for ascertaining a position of the measurement point outside the tolerance range and for outputting a fault signal depending on the ascertained position.

Advantageously therefore, underlying defects of the hearing apparatus can be detected automatically and the overall measuring situation can also be evaluated objectively. Furthermore, the claimed method makes it possible to simplify the automation or computer-supported checking, calibration and analysis of hearing devices, and further self-tests can be implemented or continued.

The fault signal is preferably a malfunction signal which suggests the malfunction of a microphone of the hearing apparatus if the at least two measurement points lie below a predetermined threshold. In particular, this makes it possible to determine whether the measurement level lies below a base noise level, thereby indicating the certain failure of a microphone.

In addition, the fault signal can be a lack-of-proofness signal which suggests the lack of proofness of a measuring chamber if a gradient of the straight line between two measurement points exceeds a predetermined first value or if the measurement point at the lowest measuring frequency lies below the tolerance range and the measurement point at the highest measuring frequency lies within the tolerance range. In this context, use is advantageously made of the fact that losses occur in the low-frequency range in the case of lack of proofness.

In addition, the fault signal can be a dirt-accumulation signal which suggests dirt accumulation at the microphone of the hearing apparatus if a gradient of the straight line between two measurement points is less than a predetermined second value or if the measurement point at the lowest measuring frequency lies within the tolerance range and the measurement point at the highest measuring frequency lies below the tolerance range. In particular, if the gradient of the straight line is negative, this is a sure sign that a microphone has dirt accumulation and therefore the high frequencies are significantly muffled.

In a preferred embodiment, the test apparatus features an internal generator for generating an acoustic test signal. This removes the need for additional signal sources for the check. Furthermore, it is advantageous if the apparatus has a sealable measuring chamber into which the hearing apparatus can be introduced for checking. This makes it possible to ensure independence from the acoustic situation of the ambient environment.

BRIEF DESCRIPTION OF THE DRAWINGS

The present invention is described in greater detail below with reference to the appended drawings, in which.

DETAILED DESCRIPTION OF THE INVENTION

Figure 1:
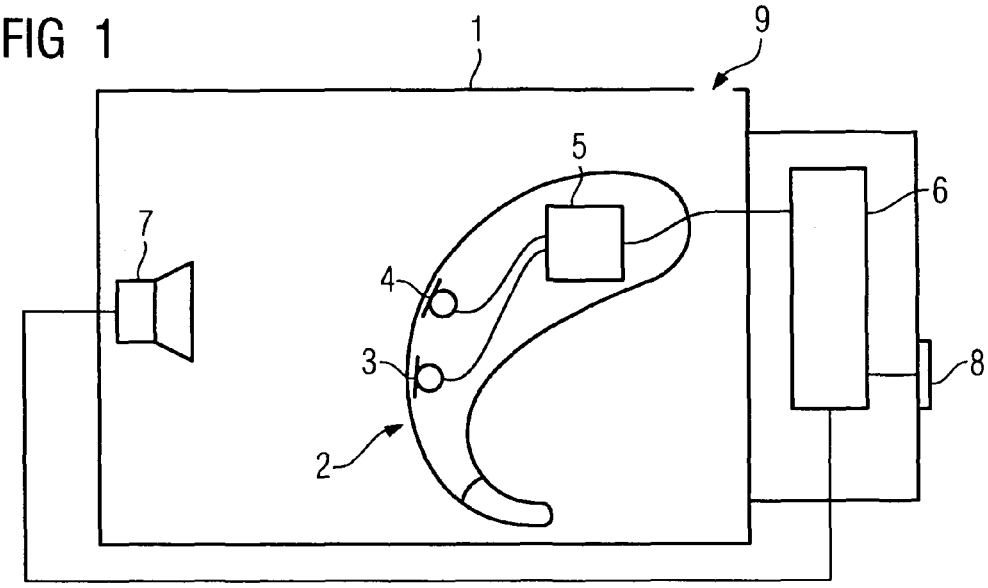
FIG. 1 shows a schematic diagram of a test apparatus according to the invention.

The test apparatus which is illustrated in FIG. 1 consists of a measuring chamber 1 into which a hearing device 2 has been placed. The hearing device 2 has two microphones 3, 4 and a signal processing unit 5. Within the measuring chamber 1, the hearing device 2 is connected to a measuring unit 6 via a suitable interface. The measuring entity 6 is in turn connected to a display 8.

Also located in the measuring chamber 1 is an internal generator and/or loudspeaker 7 for generating test sound signals. The generator or loudspeaker 7 can be controlled by the measuring entity 6. Even though the measuring entity 6 is mounted on the measuring chamber 1 here, it can also be a device which is independent from the measuring chamber 1.

The measuring entity 6 can also be configured to have a plurality of channels, such that a plurality of levels of microphones can be recorded simultaneously. In FIG. 1, the number of microphones is two. However, it is possible to measure just one microphone or three microphones and more. Moreover, it is not necessary for the microphone or microphones to be integrated in a hearing device 2. Indeed, the measuring apparatus can also be used for microphones which are not integral.

Before the individual microphones 3, 4 can be balanced in relation to each other, it is also appropriate to check whether the microphones 3, 4 are functionally efficient and/or whether the measuring chamber 1 is adequately proof. Balancing of the microphones or adjustment of the hearing device can only be done in a correct measuring situation.

Figure 2:
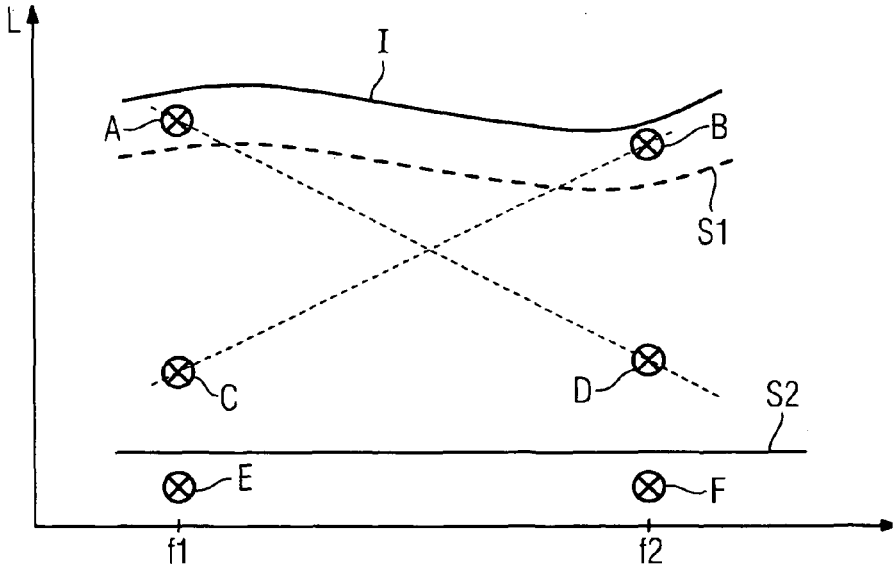
FIG. 2 shows level measurements depending on the frequency.

FIG. 2 shows a plurality of different frequency paths which can be traced back to different measuring situations. The curve I depicts the frequency path of a microphone in an ideal case. A threshold S1 lies at a tolerance distance relative to the ideal curve I. Situated above the threshold S1 is a tolerance range in which the microphone is classified as working correctly. If a measurement point lies below the threshold S1, a fault is present in the measuring situation according to the definition.

In the example selected in FIG. 2, two measurements are carried out for checking the microphone: one at the frequency f1 and the other at the frequency f2. A test frequency f1 is typically lower than 1000 Hz and a test frequency f2 is typically higher than 2000 Hz. The display element 8 (cf. FIG. 1) shows the user a corresponding OK signal.

In a first measurement, the measurement points A and B are ascertained. Both measurement points lie above the threshold S1. This signifies that the microphone is functioning correctly. Therefore the microphone can be balanced or adjusted.

In a second measurement, the measurement points A and D are ascertained. This means that the level is low in the case of high frequencies, whereas it is high in the case of low frequencies. This is an indication that the microphone is blocked by dirt accumulation. In accordance with FIG. 1, the measuring entity 6 therefore outputs a dirt-accumulation signal to the operator via the display entity 8. The microphone must therefore be cleaned in order to utilize the hearing device further.

In a third measurement, the measurement points C and B are ascertained. This means that the signal is satisfactory in the case of high frequencies, while the low frequencies are too severely muffled since the point C lies below the threshold S1. This indicates that the measuring chamber 1 has a lack of proofness 9 (cf. FIG. 1). Consequently, the measuring chamber must be sealed in order to obtain reliable measurement results.

In a fourth measurement, the measurement points E and F are ascertained. They both lie below the second threshold S2, whose level merely corresponds to a noise level. It must therefore be assumed that the microphone is malfunctioning. A corresponding repair or a replacement must take place before the microphone is used further. This microphone malfunction is also reported to the user by the measuring entity 6 via the display element 8.

In the above-described example, the measuring situation was classified with reference to two measured values. A more finely differentiated evaluation can be obtained using a plurality of measurement points. In principle, the measurement can be refined as required until finally a complete spectral range is recorded and analyzed. In each case, information about the measuring situation or the status of the microphone can be ascertained automatically therefrom.

The measuring method as claimed in the invention can also be used for a plurality of microphones in parallel or in series. In order to achieve this, the measurement points or measurement curves are recorded for each microphone as per FIG. 2 and the corresponding information is derived therefrom. When checking a plurality of microphones, the display via the display element 8 requires a more finely differentiated configuration, such that the user receives the corresponding malfunction signal, lack-of-proofness signal, etc. with reference to the relevant microphone.

The proposed method makes it possible to simplify the automation or computer-supported checking, calibration and analysis of hearing devices. Moreover, further self-tests can be implemented or continued automatically.

The invention claimed is:

1. A method for checking a measuring situation when testing a hearing apparatus in a measuring chamber, comprising:

recording a plurality of measurement points at a plurality of measuring frequencies for a frequency response of the hearing apparatus;

checking whether the measurement points lie in a predetermined tolerance range;

outputting an OK signal if the measurement points are in the predetermined tolerance range; and outputting a fault signal if at least one of the measurement points is outside the predetermined tolerance range, wherein the fault signal indicates a lack of proofness of the measuring chamber if a gradient of a straight line between two of the measurement points exceeds a predetermined first value, wherein the fault signal indicates a lack of proofness of the measuring chamber if one of the measurement points at the lowest measuring frequency is below the predetermined tolerance range and another one of the measurement points at the highest measuring frequency is within the predetermined tolerance range, wherein the fault signal indicates a dirt accumulation at a microphone of the hearing apparatus if a gradient of a straight line between two of the measurement points is less than a predetermined second value, wherein the fault signal indicates a dirt accumulation at a microphone of the hearing apparatus if one of the measurement points at the lowest measuring frequency is within the predetermined tolerance range and another one of the measurement points at the highest measuring frequency is below the predetermined tolerance range.

2. The method as claimed in claim 1, wherein a position of the measurement point outside the predetermined tolerance range is ascertained and the fault signal is outputted based on the ascertained position.

3. The method as claimed in claim 1, wherein the predetermined tolerance range is between a frequency response of a microphone of the hearing apparatus in an ideal situation and a predetermined threshold value of the microphone of the hearing apparatus.

4. The method as claimed in claim 3, wherein the fault signal indicates a malfunction of the microphone of the hearing apparatus if the measurement points are below the predetermined threshold value.

5. The method as claimed in claim 4, wherein the predetermined threshold value is a noise level.

6. The method as claimed in claim 1, wherein the method is used for checking the measuring situation when adjusting the hearing apparatus in the measuring chamber.

7. An apparatus for checking a measuring situation when testing a hearing apparatus in a measuring chamber, comprising:

a measuring unit that records a plurality of measurement points at a plurality of measuring frequencies for a frequency response of the hearing apparatus; and an analysis unit that checks whether the measurement points are in a predetermined tolerance range and outputs:

an OK signal if the measurement points are in the predetermined tolerance range, and a fault signal if at least one of the measurement points is outside the predetermined tolerance range, wherein a position of the measurement point outside the predetermined tolerance range is ascertained and the fault signal is outputted based on the ascertained position, wherein the fault signal indicates a lack of proofness of the measuring chamber if a gradient of a straight line between two of the measurement points exceeds a predetermined first value, wherein the fault signal indicates a lack of proofness of the measuring chamber if one of the measurement points at the lowest measuring frequency is below the predetermined tolerance range and another one of the measurement points at the highest measuring frequency is within the predetermined tolerance range, wherein the fault signal indicates a dirt accumulation at a microphone of the hearing apparatus if a gradient of a straight line between two of the measurement points is less than a predetermined second value, wherein the fault signal indicates a dirt accumulation at a microphone of the hearing apparatus if one of the measurement points at the lowest measuring frequency is within the predetermined tolerance range and another one of the measurement points at the highest measuring frequency is below the predetermined tolerance range.

8. The apparatus as claimed in claim 7, further comprising an internal generator that generates an acoustic test signal.

9. The apparatus as claimed in claim 7, wherein the measuring chamber is a sealable measuring chamber.

10. The apparatus as claimed in claim 7, wherein the fault signal indicates a malfunction of a microphone of the hearing apparatus if the measurement points are below the predetermined tolerance range.

11. The apparatus as claimed in claim 7, wherein the predetermined tolerance range is a tolerance distance between a frequency response of a microphone of the hearing apparatus in an ideal situation and a predetermined threshold value of the microphone of the hearing apparatus.

12. The apparatus as claimed in claim 7, wherein the apparatus is used for checking the measuring situation when adjusting the hearing apparatus in the measuring chamber.

13. The method as claimed in claim 1, wherein the lowest measuring frequency is lower than 1000 Hz and the highest measuring frequency is higher than 2000 Hz.

* * * * *